United States Patent [19]

Fall

[11] 3,950,040

[45] Apr. 13, 1976

[54] THIN-LINE CIRCULATING BALL DRAWER SLIDE

[76] Inventor: Herbert S. Fall, 6248 E. Iona Road, Indianapolis, Ind. 46203

[22] Filed: Jan. 21, 1974

[21] Appl. No.: 434,813

[52] U.S. Cl. ..... 308/6 C; 308/3.8
[51] Int. Cl.[2] ..... F16C 17/00
[58] Field of Search ..... 308/6 C, 3.8, 6 R

[56] References Cited

UNITED STATES PATENTS

| | | | |
|---|---|---|---|
| 2,708,285 | 5/1955 | Greenspon et al. | 308/3.8 |
| 3,035,873 | 5/1962 | Fall | 308/3.8 |
| 3,059,978 | 10/1962 | Fall | 308/6 C |
| 3,371,968 | 3/1968 | Loake | 308/3.8 |
| 3,608,985 | 9/1971 | Swanson | 308/6 C |
| 3,776,608 | 12/1973 | Fall et al. | 308/3.8 |

FOREIGN PATENTS OR APPLICATIONS

| | | | |
|---|---|---|---|
| 730,922 | 2/1932 | France | 308/6 C |

*Primary Examiner*—Charles J. Myhre
*Assistant Examiner*—R. H. Lazarus
*Attorney, Agent, or Firm*—Jenkins, Hanley & Coffey

[57] ABSTRACT

A slide assembly comprising a relatively fixed elongated track member, a relatively movable elongated track member, and an intermediate elongated track member movable relative to the fixed and movable track members, each track member having upper and lower longitudinally extending, parallel edge portions. The intermediate track member provides, respectively, at its upper and lower edge portions, a first set of upwardly and downwardly opening, longitudinally extending channels and, intermediate its upper and lower edge portions, a second set of upwardly and downwardly opening, longitudinally extending channels in vertical registry with the first-mentioned channels. The upper and lower edge portions of the fixed track member provide downwardly and upwardly longitudinally extending runners extending respectively into the first set of channels while the upper and lower edge portions of the movable track member provide downwardly and upwardly longitudinally extending runners extending respectively into the second set of channels. Then, the intermediate track member provides a plurality of closed-loop path ball bearing raceways between the upwardly opening channel of the first set and the downwardly opening channel of the second set and a plurality of closed-loop path ball bearing raceways between the downwardly opening channel of the first set and the upwardly opening channel of the second set. Ball bearings substantially fill the raceways, and the raceways are in communication, respectively, with the channels such that the track members are freely movably supported relative to each other by the ball bearings.

2 Claims, 11 Drawing Figures

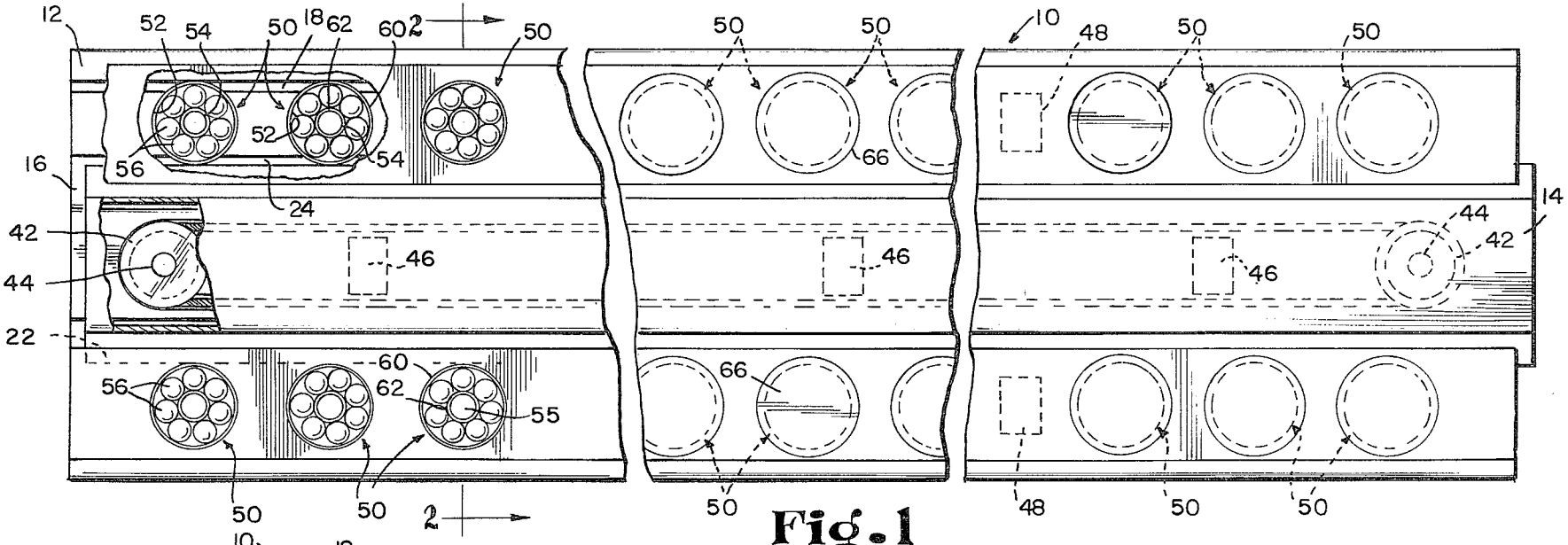
Fig. 1
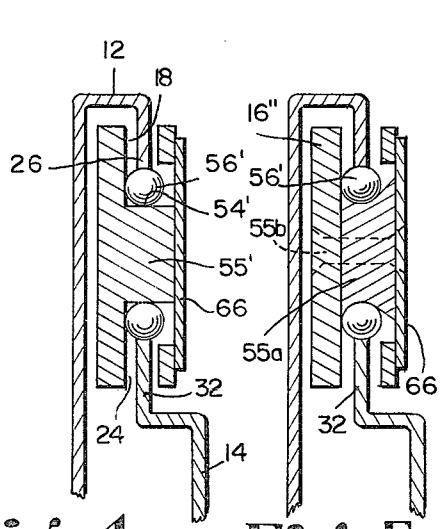
Fig. 5
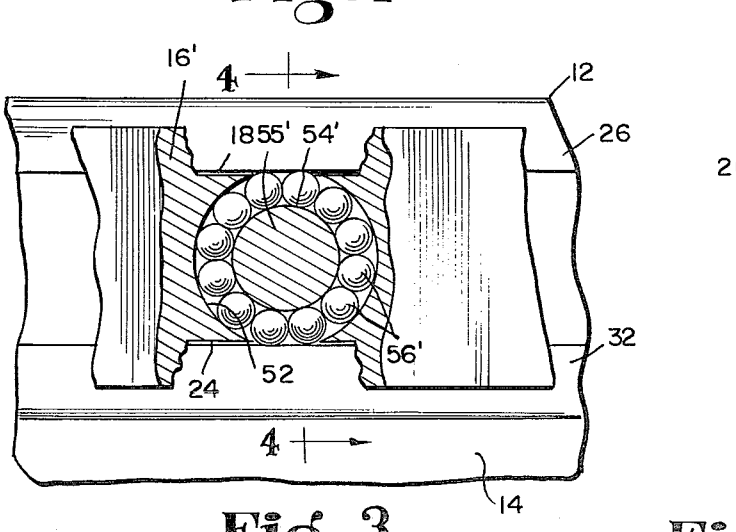
Fig. 4
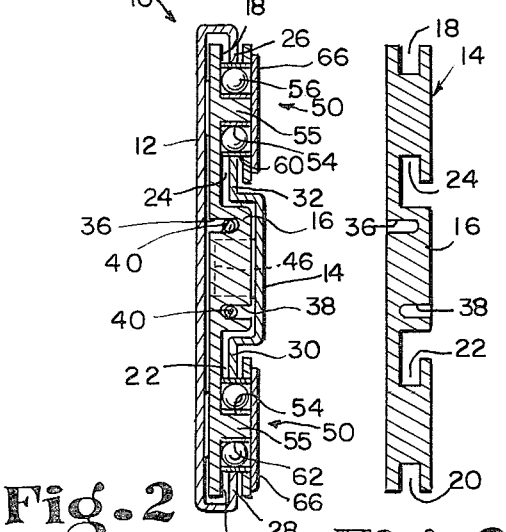
Fig. 3
Fig. 2a
Fig. 2

THIN-LINE CIRCULATING BALL DRAWER SLIDE

The present invention relates to drawer slides, and more particularly to circulating ball bearing drawer slides of the type shown in the Fall U.S. Pat. No. 3,059,978 issued Oct. 23, 1962. Improvements upon the initial circulating ball bearing drawer slides disclosed in U.S. Pat. No. 3,059,978 were disclosed in the Herbert S. Fall et al. patent application Ser. No. 321,535 filed Jan. 5, 1973, now U.S. Pat. No. 3,776,608.

Circulating ball bearing drawer slides have been on the market for several years now and have been used movably to support relatively heavy loads. For instance, circulating ball bearing slides are particularly suited for movably supporting drawers in cabinets, which drawers are filled with heavy electronic gear. Such drawer slides are attractive because they provide great load-carrying capacity while occupying a minimum amount of space in the horizontal direction. The circulating ball bearings are an ideal means for reducing friction, thereby to make it much easier to move the supported load rectilinearly.

In the past, circulating ball bearing drawer slides of the type shown in U.S. Pat. No. 3,059,978 have had ball bearings circulating about closed-loop raceways or paths extending throughout the length of the drawer slides. Such slides have included a first elongated track member, a second elongated track member generally parallel to the first track member, and a third elongated track member disposed between and generally parallel to the first and second track members. This third track member has provided, at each of its upper and lower longitudinally extending edge portions, a pair of laterally spaced apart, longitudinally extending ball bearing raceways, one raceway adjacent the first track member and one raceway adjacent the second track member. These raceways have extended throughout the length of the third track member. Conduit means at each end of the third track member have provided passageways continuing the raceways around the end of the third track member. Then, the first and second track members have provided longitudinally extending runners extending respectively into the adjacent upper and lower raceways to engage the ball bearings therein.

The drawer slide of the present invention is an improvement over prior circulating ball drawer slides because the raceways are not laterally disposed, i.e., laterally spaced apart as described above, but, instead, are vertically disposed. Particularly, in accordance with the present invention, the third track member provides, respectively, at its upper and lower edge portions, a first set of upwardly and downwardly opening, longitudinally extending channels and, intermediate its upper and lower edge portions, a second set of upwardly and downwardly opening, longitudinally extending channels in vertical registry with the first-mentioned channels. Then, the upper and lower edge portions of the first track member or the relatively fixed track member provide downwardly and upwardly longitudinally extending runners extending respectively into the first set of channels while the upper and lower edge portions of the second track or the movable track provide downwardly and upwardly longitudinally extending runners extending respectively into the second set of channels. Since the channels are in vertical registry, the runners of the second track member are in vertical registry with the runners of the first track member.

As to the raceways, in accordance with the present invention, the third track member or the intermediate track member provides a plurality of closed-loop path ball bearing raceways between the upwardly opening channel of the first set and the downwardly opening channel of the second set and a plurality of closed-loop path ball bearing raceways between the downwardly opening channel of the first set and the upwardly opening channel of the second set. Ball bearings substantially fill these raceways, and the raceways are in communication, respectively, with the channels such that the track members are freely movably supported relative to each other by the ball bearings.

The slide of the present invention is not only laterally thinner than earlier circulating ball slides, it uses significantly less ball bearings because it has a plurality of longitudinally short raceways rather than two separate raceways running the full length of the intermediate member. This feature provides a significant cost advantage because ball bearings constitute a significant portion of the cost of such circulating ball drawer slides.

In one preferred embodiment of the present invention, each of the plurality of raceways is cylindrically formed about an axis extending horizontally and perpendicularly to the direction of extension of the channels, each said raceway having a concentric outer diameter surface and a concentric internal diameter surface with the outer diameter surface intersecting its respective channels. In some cases, for wear purposes, a cylindrically-formed wear band may be disposed in each raceway to enclose the ball bearings therein, the wear band being rotatably movable relative to the outer diameter surface of the raceway. In this embodiment, the runners extending into the channels engage the wear bands.

In another preferred embodiment of the present invention, each raceway is elongated in the direction of extension of the channels to provide an upper rectilinear run generally parallel to and in communication with its associated upwardly facing channel, a lower rectilinear run generally parallel to and in communication with its associated downwardly opening channel, and end runs connecting said upper and lower runs. In this embodiment, the runners of the first and second track members engage the ball bearings respectively in the upper and lower runs of the raceways. Preferably, in this embodiment, the third track member has a generally vertically extending side wall and is formed with elongated cavities in the side wall defining the raceways, each cavity having an outer perimetral wall defining the outer perimeter of its said raceway. Then, an elongated race member is centrally disposed in each cavity to have its outer perimetral edge define the inner perimeter of the raceway of the cavity. The ball bearings are disposed within and fill the space between the outer wall and the race member of each cavity. Further, as will be discussed in more detail hereinafter, each of these race members is preferably connected to the third track member for slight shifting movement vertically from its central position in its respective cavity. This shifting movement is very important in that it accommodates the bending moments of the track members to keep the ball bearings uniformly contacting the runners extending into the raceways. The race members may be constructed from materials such that they do not have significant deflection characteristics as compared to the sheet metal or extruded track members.

It is an object of the present invention, therefore, to provide a drawer slide having the advantageous characteristics of a circulating ball drawer slide but which is much thinner than conventional circulating ball drawer slides and which uses significantly less ball bearings for the same extension requirements. Another object of the present invention is to provide a circulating ball drawer slide including an intermediate track member providing a plurality of closed-loop path ball bearing raceways instead of a pair of raceways running the full length of the intermediate track member. Still another object of the present invention is to provide such a drawer slide in which the raceways are vertically oriented such that the runners of the fixed and movable track members, i.e., outer and inner track members, are in vertical registry with the raceways.

Other objects and features of the present invention will become apparent as this description progresses.

To the accomplishment of the above and related objects, this invention may be embodied in the forms illustrated in the accompanying drawings, attention being called to the fact, however, that the drawings are illustrative only, and that change may be made in the specific constructions illustrated and described, so long as the scope of the appended claims is not violated.

IN THE DRAWINGS:

FIG. 1 is an elevational view, partially cut away and partially sectioned, of one embodiment of the slide of the present invention;

FIG. 2 is a sectional view taken generally along lines 2—2 in FIG. 1;

FIG. 2A is an end view of the intermediate track member.

FIG. 3 is a fragmentary and enlarged view showing a cylindrical raceway.

FIG. 4 is a fragmentary sectional view taken along the line 4—4 in FIG. 3;

FIG. 5 is a fragmentary sectional view showing a different technique for forming the inner raceway of the embodiment of FIGS. 3 and 4;

Figure 6:
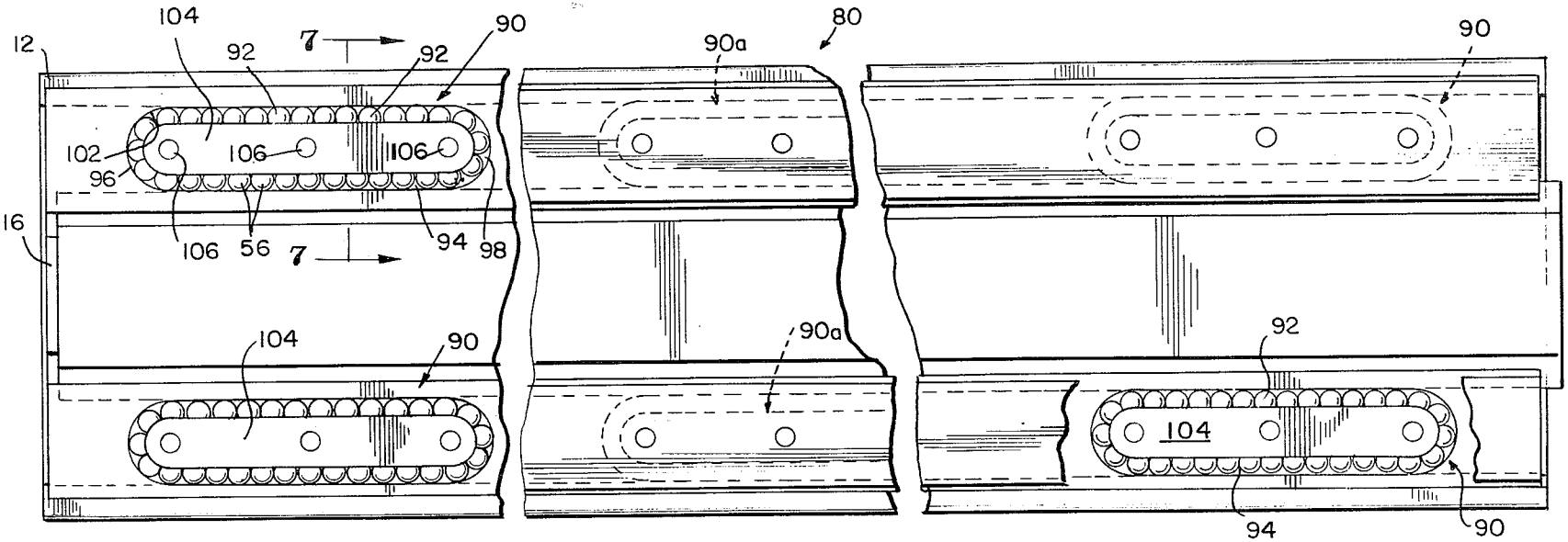
FIG. 6 is a view similar to FIG. 1 except that it shows a plurality of elongated raceways rather than the cylindrical raceways.

Turning now to the drawings, it will be seen that there is illustrated several embodiments of the present invention, like reference numerals indicating like parts. In the embodiment of FIGS. 1 and 2, the drawer slide 10 comprises a first track member 12 which is conventionally the relatively fixed track member in that it is fastened to the frame of the cabinet in which the drawer is mounted. A second track member 14 which is the movable track member in that it is conventionally attached directly to the drawer is provided, this track member 14 being generally parallel to the first track member 12. Then, a third track member 16 is disposed between and generally parallel to the first and second track members 12, 14. This third track member is conventionally referred to as the intermediate track member. The three track members 12, 14, 16 are horizontally elongated and parallel, and their lengths may be substantially equal. Each of the track members has an upper and lower longitudinally extending edge portion formed as will be described hereinafter.

The intermediate track member 16 is formed to provide, respectively, at its upper and lower edge portions, a first set of upwardly and downwardly opening, longitudinally extending channels 18, 20 and, intermediate its upper and lower edge portions, a second set of upwardly and downwardly opening, longitudinally extending channels 22, 24 in vertical registry with the first-mentioned channels. Then, the upper and lower edge portions of the first track member 12 provide downwardly and upwardly longitudinally extending runners 26, 28 extending respectively into the first set of channels 18, 20. The upper and lower edge portions of the second track member 14 are formed to provide downwardly and upwardly longitudinally extending runners 30, 32 extending respectively into the second set of channels 22, 24. The channels 18, 20, 22, 24 and the runners 26, 28, 30, 32 serve to hold the track members 12, 14, 16 laterally together for relative telescopic movement in the direction of their length.

While the track members 12, 14 may be ideally formed from sheet metal strips either by conventional roll-forming techniques or pressing techniques, the intermediate track member 16 may ideally be formed by metal extrusion processes and particularly by aluminum extrusion processes. The cross sectional shape of the extruded aluminum intermediate track member 16 with its channels 18, 20, 22, 24 and with grooves 36, 38 for receiving runs 40 of a synchronizing cable drive system is shown in FIG. 2A.

As will be discussed hereinafter, the intermediate track member 16 may be machined or otherwise formed to provide cavities in its side wall defining closed-loop path ball bearing raceways between the upwardly opening channel 18 of the first set and the downwardly opening channel 24 of the second set as well as a plurality of closed-loop path ball bearing raceways between the downwardly opening channel 20 of the first set and the upwardly opening channel 22 of the second set. The raceways are in communication respectively with the channels such that the track members 12, 14, 16 are freely movably supported relative to each other by ball bearings substantially filling the raceways.

The cable 40 is trained about pulleys 42 journal mounted at opposite ends of the intermediate track member 16 on trunnions as indicated at 44. In order to provide synchronization, the track members 12 and 14 are both connected to the cable such that any movement of the track member 14 relative to the track member 12 will cause a corresponding movement of the intermediate track member 16 in the same direction and at one-half the velocity. Such a cable drive system is disclosed in U.S. Pat. No. 3,687,505 issued Aug. 29, 1972 on an application by Messrs. Maxwell S. Fall and Ronald D. Lambert. Further, for the reasons outlined in the above-mentioned pending Fall et al. application Ser. No. 321,535 filed Jan. 5, 1973, stabilizing rollers 46, 48 or other such roller means or bearing means are utilized to keep the first and second track members 12, 14 from moving or twisting out of their respective vertical planes. A plurality of such rollers journal mounted for rotation about vertical axes on the intermediate track member 16 may be used to engage and stabilize the second track member 14 while a plurality of such rollers 48 may be journal mounted for rotation about vertical axes adjacent the upper and lower edge portions of the intermediate track member to engage and stabilize the first track member 12.

In the embodiments of FIGS. 1–5, the raceways are cylindrically formed about axes extending horizontally outwardly and perpendicular to the direction of extension of the channels 18–24. Such raceways are indicated by the reference numeral 50 in the embodiment of FIGS. 1 and 2. It will be seen that such cylindrical raceways 50 have a concentric outer diameter surface 52 and a concentric internal diameter surface 54 with the outer diameter surface 52 intersecting its respective channels and, more specifically, the bottoms of the channels. In other words, the diameter of the outer surface 52 is greater than the vertical distance between the bottoms of the channels 18, 24 and 20, 22 such that the outer diameter surface 52 intersects the channels. The internal diameter surface 54, of course, defines a horizontally outwardly extending trunnion 55, and the space between the trunnion and the outer diameter surface 52 is filled with ball bearings 56.

In the embodiment of FIGS. 1 and 2, a cylindrically formed steel outer wear band 60 is disposed in each raceway 50 to enclose the ball bearings 56 therein, the wear band being rotatably movable relative to the outer diameter surface 52. The runners 26, 28, 30, 32 engage the outer wear bands 60. A second cylindrically-formed steel inner wear band may be disposed in each raceway 50 to enclose the internal diameter surface 54 thereof.

While the intermediate track member 16 may be extruded aluminum, the wear bands 60, 62, the ball bearings 56 and the track members 12, 14 may be steel such that, in the embodiment of FIGS. 1 and 2, all load-bearing wear surfaces are steel.

When the extension action occurs, i.e., when the track member 14 and track member 16 move relative to the track member 12, the ball bearings 56 will circulate about their illustrated circular paths to reduce the friction of such movement. In other words, the wear bands 60 are rotatably supported by the ball bearings 56 which circulate about their circular paths.

The embodiment of FIGS. 3 and 4 is similar to the embodiment of FIGS. 1 and 2 except that the wear bands 60, 62 are omitted and the intermediate track member 16′ is formed with larger internal diameter surfaces 54′ to provide larger trunnions 55′ to accommodate a greater quantity of smaller diameter ball bearings 56′. It will be appreciated that the number of ball bearings 56′ and their size and the dimensions of the raceways may be established to provide a smooth circulating action.

The embodiment of FIG. 5 is similar to the embodiment of FIGS. 3 and 4 except that instead of machining the raceway to leave a trunnion 55′, a trunnion **55*a* is fabricated and then fastened in the raceway by means such as the illustrated rivet 55*b*. The illustrated trunnion 55*a* is formed with a groove extending about its periphery, the groove having a part circular cross section to conform to the ball bearings 56′.**

In the embodiments 1–5, the raceways may be covered by individual cover plates 66 conventionally fastened to the intermediate track member. Alternatively, a single, relatively thin and longitudinally extending cover plate may be used to cover the raceways on the upper level and another such cover plate may be used to cover the raceways on the lower level.

In the embodiment of FIG. 1, three sets of raceways are shown on each of the upper and lower levels, one set adjacent each end of the intermediate track member and one set in its center portion. With such an arrangement of raceways, the movable track member 14, which is attached to a drawer, can be extended in either direction from its normal position adjacent the fixed track member 12 by a distance approximately equal to the length of the track member 14 and still have the runners 26, 28, 30, 32 well engaged with the ball bearings or with the wear bands 60 enclosing the ball bearings. In FIGS. 6–10, it will be seen that each of the illustrated raceways 90 is elongated in the direction of extension of the channels 18-24 to provide an upper rectilinear run 92 generally parallel to and in communication with its associated upwardly opening channel, a lower rectilinear run 94 generally parallel to and in communication with its associated downwardly-opening channel, and end runs 96, 98 connecting the upper and lower runs. The runners 26, 28, 30, 32 of the first and second track members 12, 14 engage the ball bearings respectively in the upper and lower runs 92, 94.

Figure 8:
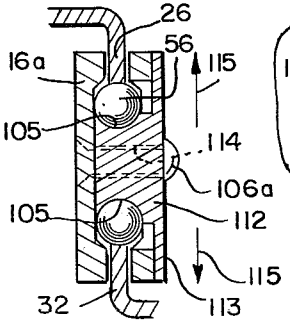
FIG. 8 is a fragmentary sectional view showing the fabricated inner race member with an integrally formed cover for the raceway.
Figure 7:
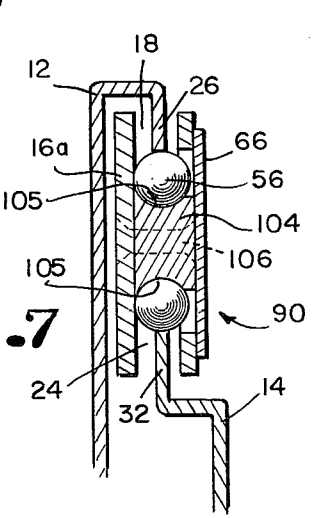
FIG. 7 is a fragmentary and enlarged sectional view taken along the lines 7—7 in FIG. 6.

It will be appreciated that the raceways 90 may be formed by machining elongated cavities 102 in the side wall of the intermediate track member. Then, an elongated race member 104 may be centrally disposed in each cavity 102 and connected to the intermediate track member by means such as the illustrated rivets 106. The illustrative race member 104 has an outer perimetral edge defining the inner perimeter of the raceway 90, and ball bearings substantially fill the space between the race member 104 and the outer perimetral wall of the cavity 102. As best seen in FIG. 7, the race member 104 may be formed with a groove 105 about its outer perimetral edge, the groove having a circular cross section conformingly to receive portions of the ball bearings 56. A cover plate 66 may be placed over each raceway as previously discussed. Alternatively, as shown in FIG. 8, the race member 112 may be formed with a cover portion 113. In the illustration of FIG. 8, the race member 112 is provided with enlarged rivet openings 114, i.e., holes of a diameter greater than the diameter of the fastening rivets **106*a* such that the entire race member may shift slightly vertically relative to the intermediate track member 16*a* as indicated by the arrows 115.**

Further, as illustrated in FIG. 8, the intermediate track member 16 may be formed in cross section such that the ball bearings will not move upwardly or downwardly out of the raceways when the runners 26–32 of the track members 12, 14 ar removed. This may be accomplished, of course, by having the lateral width of the channels 18–24 less than the diameter of the bearings.

Figure 9:
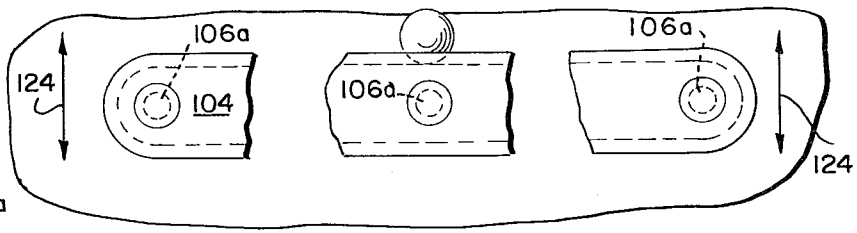
FIG. 9 is a fragmentary view of the fabricated inner race member and showing how it is mounted for slight shifting movement vertically.

As shown in FIG. 9, the race members 104 may also be attached by undersized rivets **106*a* such that the race members may shift or even pivot vertically relative to the intermediate track member 16*a* as indicated by the double-ended arrows 124. By letting the race members 104, 112 shift slightly a small distance such as 0.020 – 0.050 inch relative to the intermediate track member, the race members will adjust to the bending and loading of the drawer slides to give a more uniform loading on all the ball bearings. For instance, when the slide assembly is fully extended as illustrated in the diagrammatical view of FIG. 10, there will be a tendency, of course, for the track members to bend and distort slightly as a result of the rather large moments placed thereon. By permitting slight shifting or tilting of the relatively rigid race members 104, 112** relative to the intermediate track member, the longitudinal surfaces of the race member can be kept perpendicular to the applied loads.

Figure 10:
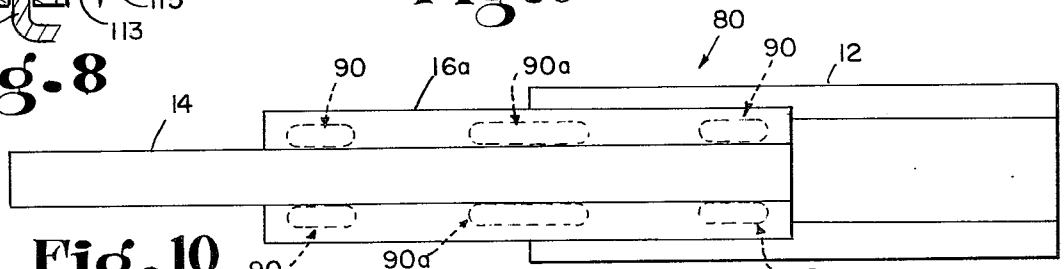
FIG. 10 is a diagrammatical view showing how such oblong raceways may be disposed on the intermediate member of a slide capable of extending in both directions relative to the fixed track member.

Further, as illustrated in FIG. 10, it may be preferable to have three upper raceways 90, 90*a* and three lower raceways 90, 90*a* to accommodate full extension of the track member 14 in both directions. The center raceways 90*a* may be, for instance, twice as long as the end raceways 90 as illustrated.

The slide of the present invention may be constructed such that it is quite thin in the lateral dimension having an overall width of ⅜ inch or not more than ½ inch and an overall height of approximately 3¼ inches. The relatively stiff race members may be made using powdered metal processes or other metal forming processes designed to produce the members.

I claim:

1. A slide assembly comprising a first horizontally elongated track member, a second horizontally elongated track member generally parallel to said first track member, a third horizontally elongated track member disposed between and generally parallel to said first and second members, each said track member having upper and lower longitudinally extending edge portions, said third track member providing, respectively at its upper and lower edge portions, a first set of upwardly and downwardly opening, longitudinally extending channels and, intermediate its upper and lower edge portions, a second set of upwardly and downwardly opening, longitudinally extending channels in vertical registry with said first-mentioned channels, the upper and lower edge portions of said first track member providing downwardly and upwardly longitudinally extending runners extending respectively into said first set of channels, the upper and lower edge portions of said second track member providing downwardly and upwardly longitudinally extending runners extending respectively into said second set of channels, said third track member providing a plurality of closed-loop path ball bearing raceways between the upwardly opening channel of said first set and the downwardly opening channel of said second set and a plurality of closed-loop path ball bearing raceways between the downwardly opening channel of said first set and the upwardly opening channel of said second set, and ball bearings substantially filling said raceways, said raceways being in communication respectively with said channels such that said track members are freely movably supported relative to each other by said ball bearings, each raceway being elongated in the direction of extension of said channels to provide an upper rectilinear run generally parallel to and in communication with its associated upwardly opening channel, a lower rectilinear run generally parallel to and in communication with its associated downwardly opening channel, and end runs connecting said upper and lower runs, said runners of said first and second track members engaging said ball bearings respectively in said upper and lower runs, said third track member having a generally vertically extending side wall and is formed with elongated cavities in said wall defining said raceways, each said cavity having an outer perimetral wall defining the outer perimeter of its said raceway, and an elongated race member centrally disposed in each said cavity and having an outer perimetral edge defining the inner perimeter of the raceway of said cavity, said ball bearings being disposed within and filling the space between said outer wall and said race member of each cavity, each of said race members being connected to said third track member for slight shifting movement vertically from its central position in its respective cavity.

2. A slide assembly comprising a first horizontally elongated track member, a second horizontally elongated track member generally parallel to said first track member, a third horizontally elongated track member disposed between and generally parallel to said first and second track members, said third track member providing upwardly and downwardly opening, longitudinally extending channels and said first and second track members providing longitudinally extending runners extending respectively into said channels to connect said track members for relative longitudinal reciprocation, said third track member providing a plurality of closed-loop path, longitudinally extending ball bearing raceways, ball bearings substantially filling said raceways, said raceways being in registery with said channels with portions of said raceways being respectively in communication with said channels such that said runners are movably supported by said ball bearings, each said passageway having an upper rectilinear run generally parallel to and in communication with its associated upwardly opening channel, a lower rectilinear run generally parallel to and in communication with its associated downwardly opening channel, and end runs connecting said upper and lower runs, said runners of said first and second track members engaging said ball bearings respectively in said upper and lower runs, and an elongated race member centrally disposed in each said raceway and having an outer perimetral edge defining the inner perimeter of the raceway with said ball bearings riding on said outer perimeter, each said race member being connected to said third track member for slight shifting movement vertically from its central position in said raceway to equalize the load on said ball bearings as said track members deflect under load.

* * * * *